United States Patent [19]

Thompson

[11] Patent Number: 4,655,457

[45] Date of Patent: Apr. 7, 1987

[54] SYSTEM TO FIT GOLF CLUB TO GOLFER

[76] Inventor: Stanley C. Thompson, 2707 S. Fairfax Ave., Culver City, Calif. 90230

[21] Appl. No.: 785,748

[22] Filed: Oct. 9, 1985

[51] Int. Cl.[4] ..... A63B 53/06

[52] U.S. Cl. ..... 273/162 R; 273/81.2; 273/80.1; 33/508

[58] Field of Search ..... 273/80.1, 162 R, 81.2, 273/80 C, 80 D, 80.2, 77 R, 77 A; 33/508, 263

[56] References Cited

U.S. PATENT DOCUMENTS 2,661,952 12/1953 Jarkson ..... 273/80.1

4,104,802 8/1978 Johnston ..... 33/508

*Primary Examiner*—George J. Marlo

*Attorney, Agent, or Firm*—William W. Haefliger

[57] ABSTRACT

A system for fitting a golf club to a user-golfer and employing a fitting club having a shaft, a handle on the shaft, and a head having a face. The system includes (a) a first pivot on the golf club proximate the head to accommodate adjustment pivoting of the head relative to the shaft, and to a selected angular position about an axis extending generally transversely to the shaft, (b) and an indicator associated with pivot to indicate the extent of said adjustment pivoting, corresponding to "lie" of the head, (c) Also provided is a second such pivot allowing adjustment pivoting of the head 90 degrees relative to the shaft and about the shaft axis, and to a position wherein the head is adjustably pivotable about the first axis, and the same indicator is thus usable to indicate adjusted head face angularity.

14 Claims, 12 Drawing Figures

SYSTEM TO FIT GOLF CLUB TO GOLFER

BACKGROUND OF THE INVENTION

This invention relates generally to the fitting of golf clubs to user-golfers in order to improve their play and scores. More specifically, it concerns adjustments in head and handle positions relative to the shaft, on a "fitting" club, and obtaining accurate measurement indications of such adjustments, so that a custom club, or set of clubs, may be crafted for the golfer, and embodying the indicated positions of head and handle.

Golfers commonly purchase golf clubs which "feel" most appropriate to them, considering their heights, arm lengths, and acquired stances when addressing a golf ball. This necessitates trying a large number of different clubs, and most frequently, the golf cannot find a set of clubs which is best fitted to him in terms of "lie" of the head, head face angularity relative to vertical, and club "length" as determined by distance of the handle from the club head. There exists a need for a quick, efficient solution to this problem.

SUMMARY OF THE INVENTION

It is a major object of the invention to meet the above need, through provision of a "fitting club", and method of custom fitting a club to a golfer, in a manner which facilitates achievement of best head lie, best head face angularity relative to vertical, and best handle length from the club head.

Basically, the invention contemplates a system for fitting a golf club to a user golfer, and employing a fitting club having a shaft, handle on the shaft, and head having a face corresponding to a ball striking face on an actual golf club. The system further includes:

(a) a first pivot on the golf club proximate the head to accommodate adjustment pivoting of the head relative to the shaft, and to a selected angular position about an axis extending generally transversely to the shaft, (b) and indicator means associated with said pivot to indicate the extent of said adjustment pivoting.

As will be seen, the system enables measurement of either, or both of: the best "lie" of the head, relative to the shaft, and the best "face angularity" of the head face, relative to vertical, and employing a single indicator means. The derived angular indication or indications can then be employed in crafting an actual club, by assembly of a similar (or the same type) head to a shaft with corresponding angularity, or angularities, relative to the shaft.

Typically, the fitting club has a hosel and the pivot is located at the hosel so that the lower portion of the hosel pivots with the head; further, the indicator typically includes a marker, and an angular indicia carrier located to cause the marker to progressively register with successive of said indicia during said pivoting, one of the marker and carrier carried by the shaft, and the other of said marker and indicia carried by the head.

A second pivot may be employed on the golf club proximate the head to accommodate adjustment pivoting of the head relative to the shaft and about an axis extending generally in the direction of the shaft, and between first and second positions in each of which the head is pivotable about the first axis relative to the shaft, the indicator means operable in one of said head positions to indicate the lie of the head and club, and operable in the other of the head positions to indicate head face angularity, relative to the shaft.

In addition, the handle may have adjustable connection to the shaft to accommodate relative axial displacement therebetween, and their rigid interconnection at a selected axial position of the handle on the shaft, whereby best handle distance from the head may be achieved. Typically, the handle includes first and second sections, the first section rotatable in one direction relative to the second section to loosen said interconnection and permit said relative axial displacement of the handle and shaft, and said first section then being rotatable in the opposite direction to tighten said interconnection.

The method of fitting a golf club to a user golfer typically, then, includes the steps:

(a) adjusting the head angularity relative to the shaft in one direction to vary the lie of the head and indicating the degree of such adjustment, and (b) adjusting the angularity of the head face relative to vertical, and indicating the degree of such adjustment.

Clubs of all types may be then fitted to a golfer, i.e. woods, irons and putters.

These and other objects and advantages of the invention, as well as the details of an illustrative embodiment, will be more fully understood from the following specification and drawings, in which:

DRAWING DESCRIPTION

DETAILED DESCRIPTION

Figure 1:
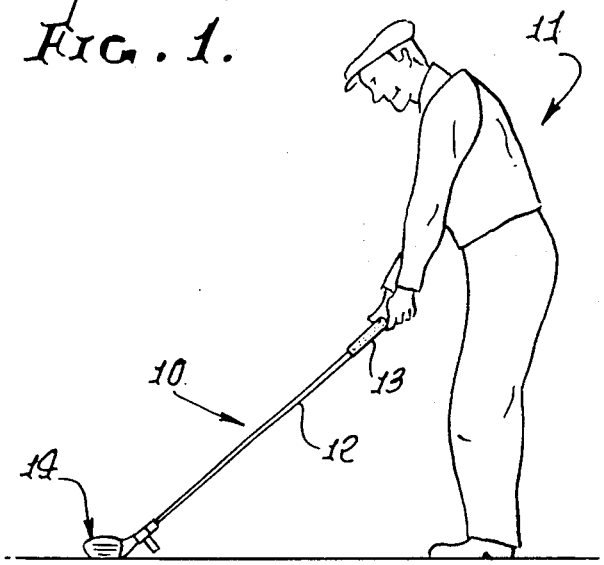
FIG. 1 is an elevation showing a golfer holding a golf club, in ball addressing position.
Figure 7:
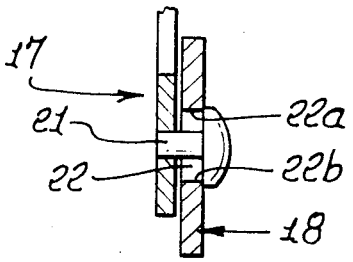
FIG. 7 is an enlarged section, taken on lines 7—7 of FIG. 6.

In FIGS. 1–8 a "fitting" golf club 10 for fitting a golf club to a user-golfer 11 employs a shaft 12, a handle 13, and a club head such as a "wood" type head 14. As referred to, the invention enables fitting of the club to the golfer in any one or any combination of three ways, i.e. club head lie, club head face angularity, and club handle distance from the head.

Basically, a first pivot is provided on the club, proximate the head, to accommodate adjustment pivoting of the head relative to the shaft, and to a selected angular position about an axis extending generally transversely of the shaft. Preferably, the pivot, as at 15, is located at the club head hosel 16, so that the entire head, including the lowermost portion of the hosel, may pivot with the head, relative to the shaft. Also included in the system is indicator means associated with the pivot to indicate the extent of such head relative pivoting. Further, and as will be seen, the invention allows use of the same indicator to indicate the extent of head pivoting in two planes, i.e. to indicate both club head lie and club face angularity.

More specifically, the indicator includes a marker 17, and an angular indicia carrier 18 located to cause the marker point 17*a* to progressively register with successive of the indicia 18*a* on the carrier, during such relative pivoting of the head and shaft. One of the marker and indicia carrier is carried by the shaft (as for example the L-shaped marker plate 17*b* having one leg projecting into the shaft and attached at 19 to the shaft bore 12*a*); and the other of the marker and indicia carrier is carried by the head (as for example the carrier plate 18*b*). Both the plate 18*b* and the pointer leg 17*c* of the marker project laterally away from the shaft so that angular motion of slight relative pivoting is amplified, for ease of viewing and angular determination at the indicia proximate the tip of the pointer leg 17*c*.

More specifically, the hosel 16 is integral with the carrier plate 18*b* and defines slot 61 extending parallel to the shaft axis. The hosel slot receives the marker corner portion 17*d*, and a pivot pin 20 extends transversely through the marker, the slot and into the sections of the hosel at opposite sides of the slot, whereby the hosel and carrier 18 may pivot relative to the marker 17, and with the head 14. A second pin 21 extends through a curved slot 22 in the carrier plate, and is attached to the marker. The ends of the slot 22 define stops 22*a* an 22*b* for the pin, whereby the extent of hosel, and carrier plate (and slot) pivoting relative to pin 21, is limited by such stops. Thus, the degree of head pivoting is accurately determinable, on opposite sides of a neutral position (FIG. 2). See FIG. 3 indicating head pivoting in one direction (arrow 23) about the transverse axis of pin 20, and FIG. 4 indicating head pivoting in the opposite direction (arrow 24) about the axis of pin 20. The "lie" of the head, relative to the shaft, and in the plane of FIGS. 1 and 2, may be accurately adjusted until it best fits the golfer user. Sliding friction between the marker and carrier plates tends to hold these elements in a selected angular position.

With this accurate angular information as indicated by the portion tip relative to the indicia, the golf club manufacture may then accurately set the "lie" angularity of "wood" head, relative to its shaft, in a custom built set of woods crafted for the golfer.

Figure 2:
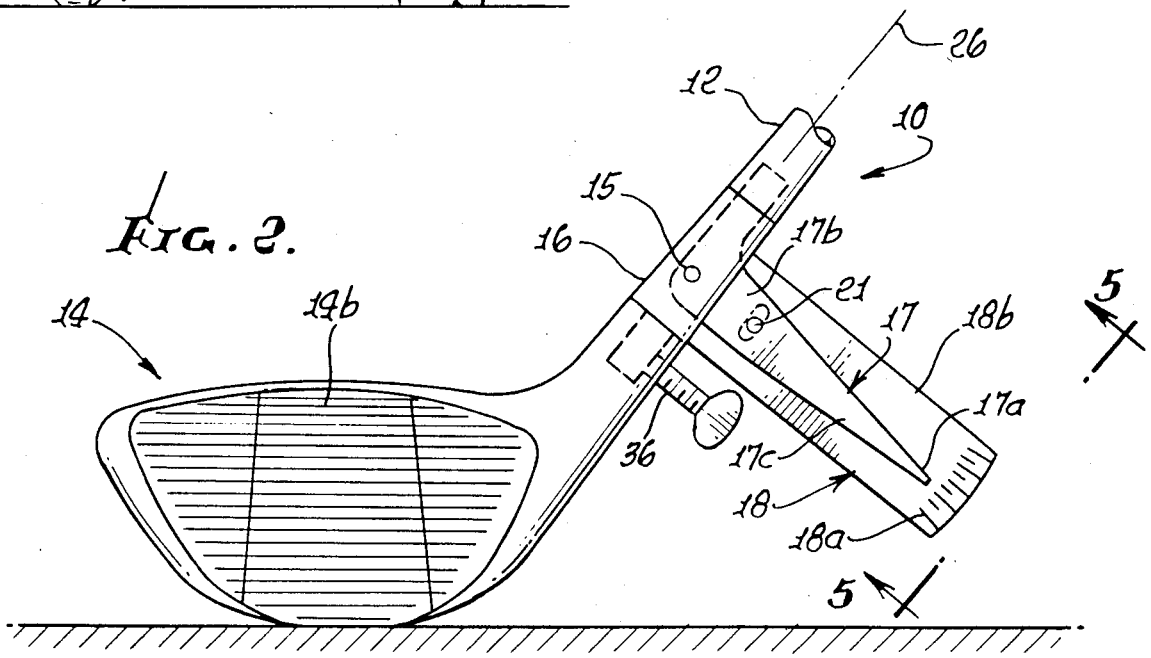
FIG. 2 is an enlarged fragmentary elevation showing a golf club head and attached shaft, and one side of an indicator.
Figure 5:
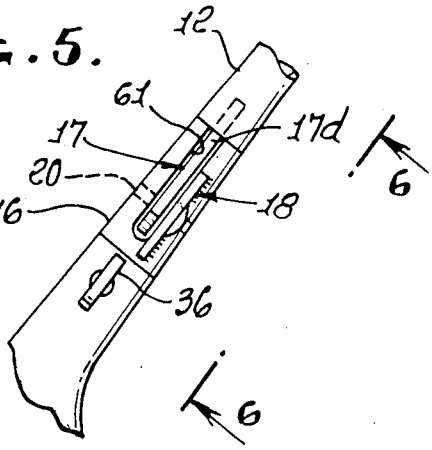
FIG. 5 is an end view, taken on lines 5—5 of FIG. 2; and of the indicator.
Figure 6:
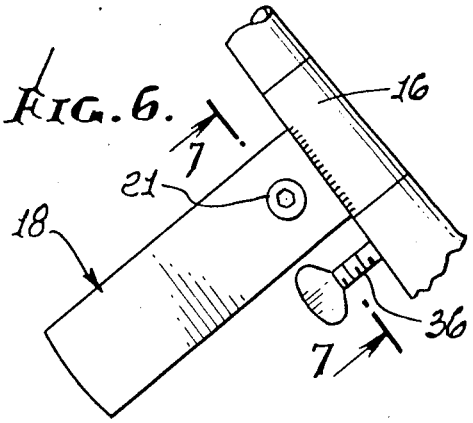
FIG. 6 is an opposite side view of the indicator on lines 6—6 of FIG. 5.
Figure 8:
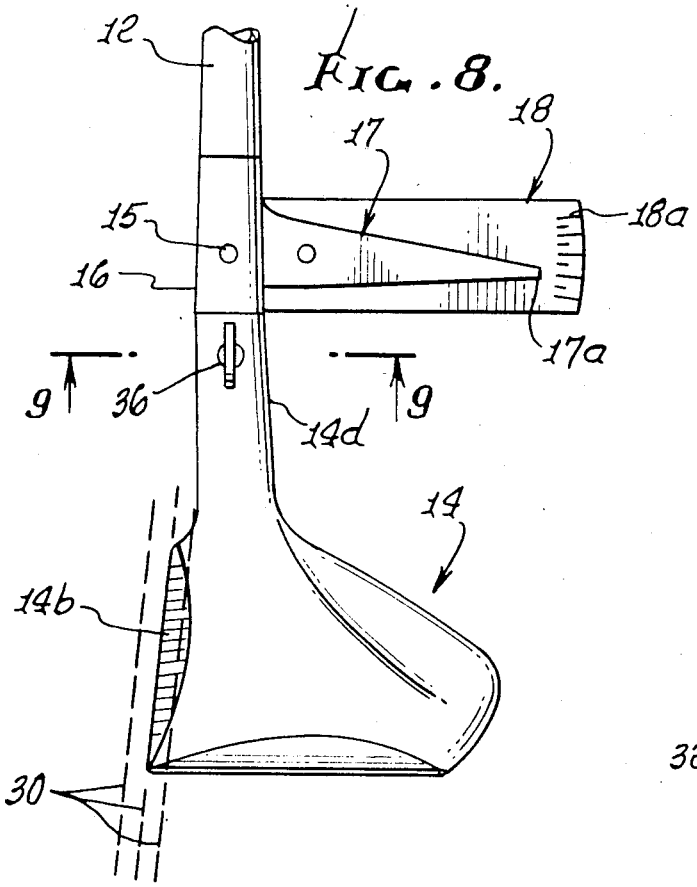
FIG. 8 is a view like FIG. 2, showing the front side of the indicator, but with head now rotated 90° relative to the indicator and relative to the shaft.

A second pivot is also provided in the club proximate the hosel portion of the head, to accommodate adjustment pivoting of the head relative to the shaft, and about an axis 26*a* extending generally in the direction of the shaft axis 26, and between first and second positions (see head first position in FIG. 1, and head second position in FIG. 8 rotated 90° relative to the first position, for example). In each such position the head is pivotable about the axis of pin 20, as described above. In the second position, of FIG. 8, adjustment pivoting of the head about the transverse axis of pin 20 permits accurate adjustments of the angularity (relative to vertical) of the head face 14*b*, and as indicated by the marker 17 and indicia on carrier 18. See for example the broken lines 30 in FIG. 8 which correspond to possible adjustment positions of the head face 14*b*. Thus, the same marker and indicia carrier are useful in each head position (FIG. 2 and FIG. 8), to facilitate accurate adjustment determination of best head "lie" angles relative to the shaft, and best head "face" angularity, relative to vertical, for a selected "lie" position of the head, and the ultimate club manufacturer may employ such data in his custom crafting of a club for the user.

Figure 3:
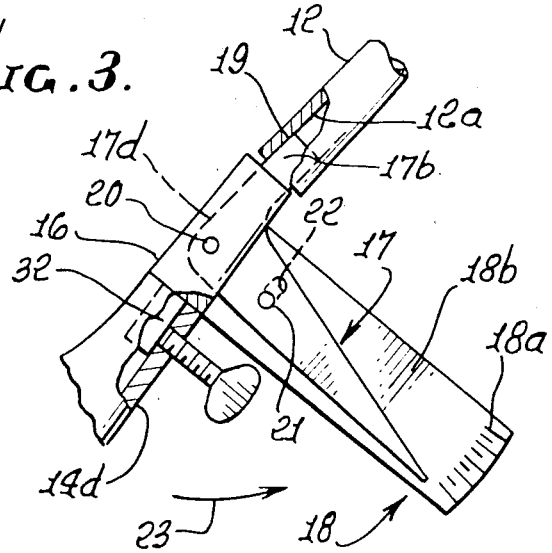
FIGS. 3 and 4 are fragmentary elevations showing different pivoted positions of the head relative to the shaft, with the indicator indicating the extents of such pivoting.
Figure 4:
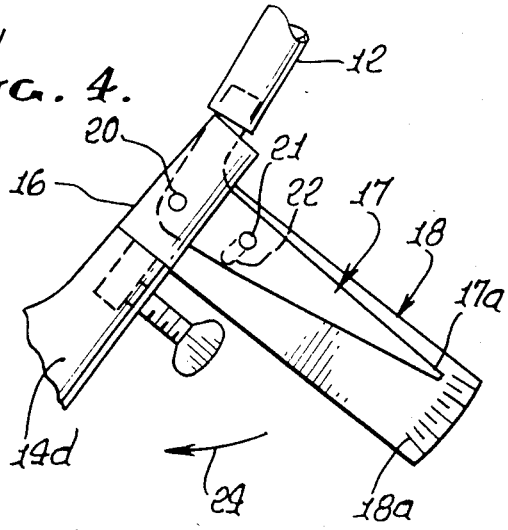
Figure 9:
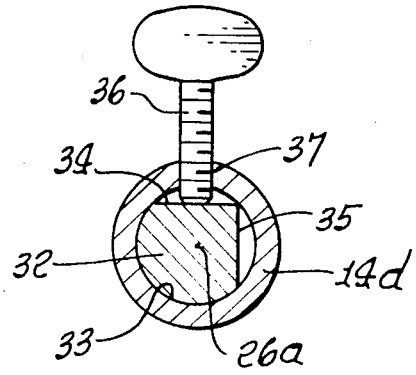
FIG. 9 is an enlarged section on lines 9—9 of FIG. 8.

More specifically, a stub shaft 32 is provided to be integral with the head hosel 16 and projects into a bore 33 in the hosel extent 14*d* of the head (see FIGS. 3 and 9). The stub shaft has two side flats 34 and 35 thereon, typically located at 90° relative angular separation, and positioned to be alternately engaged by the end of a set screw 36 threaded into the hosel at 37. Accordingly, the angular position of the head on the hosel is adjustable between FIGS. 2 and 8 positions, facilitating the use of the same marker and indicia carrying plate structures for both head "lie" and "head face angularity" adjustments to positions best fitted for a golfer.

Finally, the lengthwise position of the handle 13 on and lengthwise of the shaft 12 is adjustable, to allow for effective shaft lengthening or shortening, to best fit the golfer's requirement (considering different arm lengths and heights of different golfers) prior to or in conjunction with the "lie" and face "angularity" fits, as described above.

More specifically, the handle includes first and second sections 45 and 46, the first i.e. upper end section being rotatable in one direction about axis 26 and relative to section 46 to loosen the connection of the section 46 to the shaft. The section 46 may then be shifted lengthwise (up or down) on the shaft, for adjustment purposes. The rotatable section 45 is then rotated in the opposite direction to tighten it against section 46, at interface 47.

See in this regard, the rod 39 integral with section 45 and which projects into the tubular section 46 and into the tubular shaft 12 to thread into an internally threaded expander nut 40. Rotation of rod 39 causes the nut to travel up into axially split sleeve 41, which then grips the bore of the shaft 12, as section 45 is tightened against section 46; conversely, when section 45 is loosened, the rod retracts from the nut, and sleeve 41 loosens its grip on the shaft, to allow axial shifting of the handle section relative to the shaft. FIG. 11a shows the fingers 42 of the split sleeve 41, with splits therebetween.

Various forms of handles may be employed, and the golfer may select the one best suited to him. Such handles may vary in surface finish (more or less adhesive alike), and configuration, (flutes, tapered, cylindrical, etc.).

Figure 11:
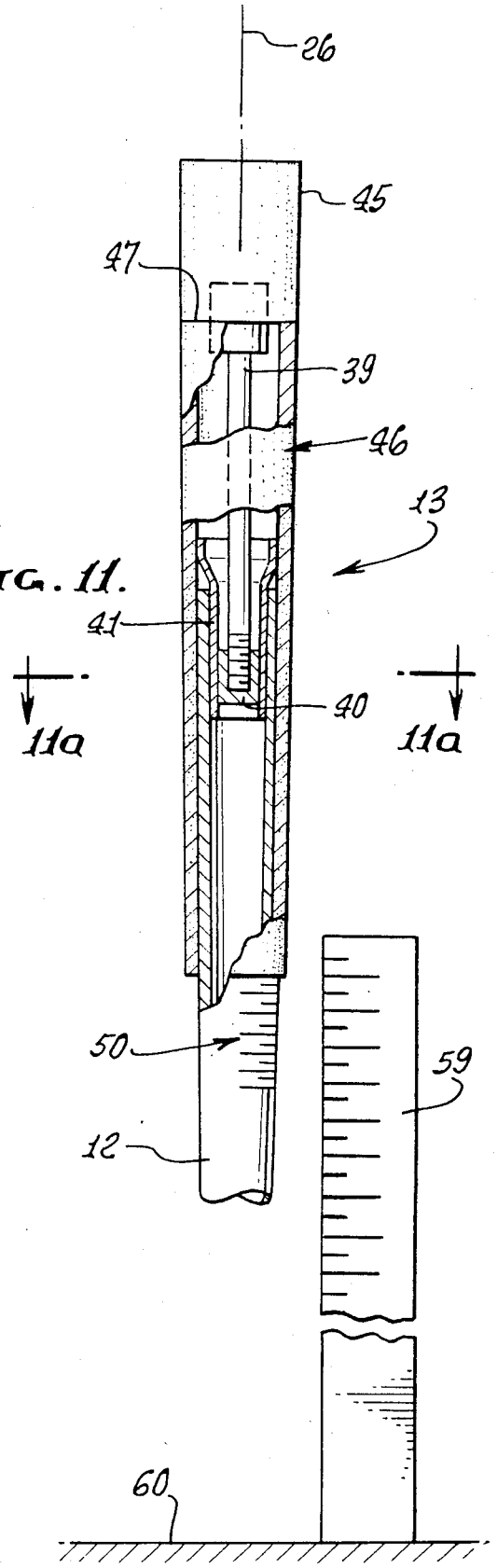
Figure 11A:
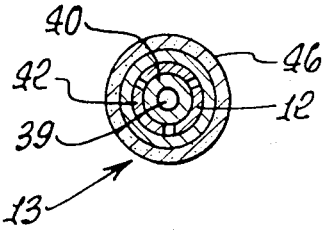

FIG. 11 also shows indicia 50 on the shaft and relative to which the handle section 46 is axially movable when the nut 40 is loosened, whereby the selected position of the handle on the shaft may be accurately determined.

A measurement stick 59 such as a yardstick may be employed to measure the actual handle distance from the ground 60, when the club is oriented vertically, with head engaging the ground, as in FIG. 1, the stick shown in FIG. 11.

Figure 10:
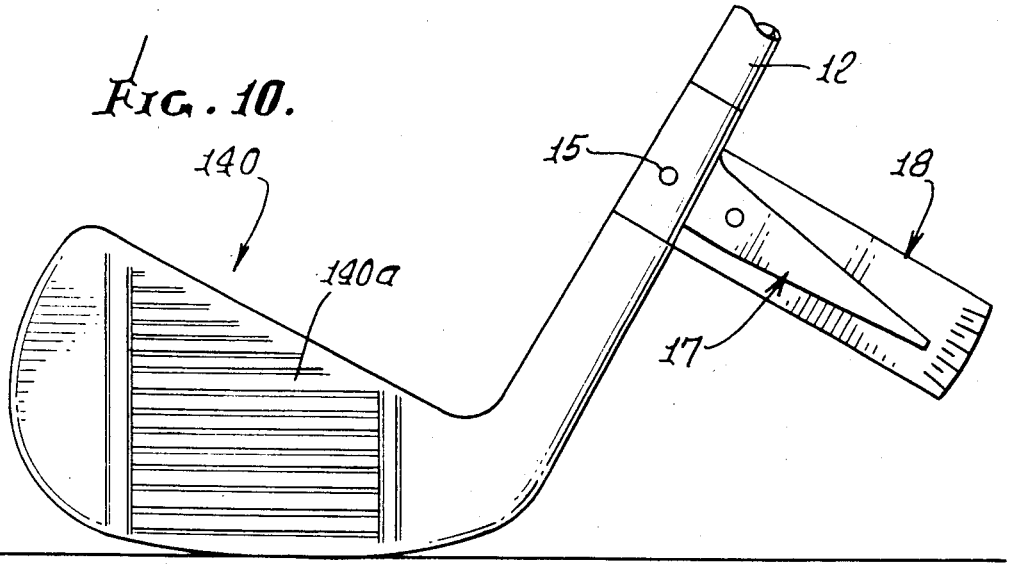
FIG. 10 is a view like FIG. 2, but showing the head in the form of an iron instead of a wood.

FIG. 10 shows a golf club in the form of an iron having a head 140, and to which the invention is applied. Head has a face 140*a* corresponding to wood head face 14*a*, In all other respects, the structure is the same as in FIGS. 1–9.

I claim:

1. In a system for fitting a golf club to a user-golfer, and employing a fitting club having a shaft, a handle on the shaft, and a head having a face, the combination comprising (a) a first pivot on the golf club proximate the head to accomodate adjustment pivoting of the head relative to the shaft, and to a selected angular postion about a first axis extending generally transversely to the shaft, (b) indicator means associated with said pivot to indicate the extent of said adjustment pivoting, (c) and including a second pivot on the golf club proximate the head to accomodate adjustment pivoting of the head relative to the shaft and about a second axis extending generally in the direction of ths shaft, and between first and second positions in each of which the head is pivotable about said first axis relative to the shaft, the indicator means operable in one of said head positions to indicate the lie of the head and club, and operable in the other of the head positions to indicate head face angularity relative to the shaft, (d) said first and second positions being located with 90° angularity therebetween, about an axis extending generally in the direction of the shaft, (e) said indicator means including a marker, and an angular indicia carrier located to cause the marker to progressively register with successive of said indicia during said pivoting, one of the marker and carrier carried by the shaft, and the other of said marker and indicia carried by the head.

2. The system of claim 1 wherein the club has a hosel, and the first pivot is located at the hosel so that the lower portion of the hosel pivots with the head.

3. The combination of claim 1 wherein said carrier and marker project outwardly away from the shaft.

4. The combination of claim 3 wherein said carrier is in the form of a plate integral with the head, and said marker is in the form of a pointer integral with the shaft.

5. The combination of claim 1 wherein said club includes a hosel portion which defines a slot into which the marker extends, and said first pivot includes a pin extending through the marker, and the slot, there being stop shoulders on the carrier to limit said head pivoting at pivot positions on opposite sides of a neutral position wherein said hosel portion is axially aligned with the shaft.

6. The combination of claim 1 including a stub shaft integral with a hosel portion of the head, the stub shaft having two flats thereon adjusted to be engaged by a set screw to lock the head in one or the other of said two positions.

7. The combination of one of claims 1 or 6 wherein the handle has adjustable connection to the shaft to accommodate relative lengthwise displacement therebetween, and their rigid interconnection at a selected position of the handle lengthwise on the shaft.

8. The combination of claim 7 wherein the handle includes first and second sections, the first section rotatable in one direction relative to the second section to loosen said interconnection and permit said relative axial displacement of the handle and shaft, and said first section then being rotatable in the opposite direction to tighten said interconnection.

9. The combination of claim 8 including a rod member integral with said first section and projecting into the other section which is tubular, and means having threaded connection with the rod member, and responsive to rotation of the rod member by said first section to expand for gripping the shaft.

10. The combination of claim 9 wherein said means includes a sleeve and a nut to expand the sleeve to clamp the shaft as the rod is rotated.

11. The combination of claim 7 including indicia on the shaft and relative to which the handle is axially movable, whereby the selected position of the handle on the shaft may be accurately determined.

12. The method of fitting a golf club to a user golfer and employing a fitting club having an adjustable head and a handle on a shaft, the steps that include (a) adjusting the head angularity relative to the shaft in one direction to vary the lie of the head and indicating the degree of such adjustment, and (b) adjusting the angularity of the head face relative to vertical, and indicating the degree of such adjustment, (c) and rotating the head relative to the shaft between said (a) and (b) steps.

13. The method of claim 12 including employing the same indicator to indicate said adjustments in (a) and (b) of claim 12.

14. The method of claim 12 including also adjusting the distance between the head and handle.

* * * * *